US008091372B1

(12) United States Patent
Ekern

(10) Patent No.: US 8,091,372 B1
(45) Date of Patent: Jan. 10, 2012

(54) HEAT PUMP DEFROST SYSTEM

(76) Inventor: Mark Ekern, Flandreau, SD (US)

( * ) Notice: Subject to any disclaimer, the term of this patent is extended or adjusted under 35 U.S.C. 154(b) by 541 days.

(21) Appl. No.: 12/401,969

(22) Filed: Mar. 11, 2009

(51) Int. Cl.
*F25D 21/00* (2006.01)

(52) U.S. Cl. ..... 62/80; 62/129; 62/151; 62/234

(58) Field of Classification Search ..... 62/80, 81, 62/82, 129, 151, 196.4, 234, 238.7, 278, 62/513, 126
See application file for complete search history.

(56) References Cited

U.S. PATENT DOCUMENTS 4,171,622 A * 10/1979 Yamaguchi et al. ..... 62/160
4,197,716 A * 4/1980 Nussbaum ..... 62/196.4
4,406,133 A 9/1983 Saunders et al.
4,563,877 A 1/1986 Harnish
4,565,070 A * 1/1986 Raymond ..... 62/81
4,569,207 A 2/1986 James
4,766,734 A * 8/1988 Dudley ..... 62/160
4,882,908 A * 11/1989 White ..... 62/155
4,916,912 A * 4/1990 Levine et al. ..... 62/80
5,105,629 A * 4/1992 Parris et al. ..... 62/278
5,319,943 A * 6/1994 Bahel et al. ..... 62/156
5,507,154 A * 4/1996 Grant ..... 62/156
5,515,689 A * 5/1996 Atterbury ..... 62/80
6,205,800 B1 * 3/2001 Topper et al. ..... 62/156
6,318,095 B1 11/2001 Guo et al.
6,931,871 B2 8/2005 Shaw et al.
6,988,374 B2 1/2006 Chang et al.
7,004,246 B2 * 2/2006 Gavula ..... 165/299
7,191,604 B1 3/2007 Wiggs
7,290,600 B2 * 11/2007 Gavula ..... 165/231
2003/0116637 A1 6/2003 Ellingham
2008/0041072 A1 2/2008 Seefeldt

* cited by examiner

*Primary Examiner* — Mohammad Ali
(74) *Attorney, Agent, or Firm* — Neustel Law Offices

(57) ABSTRACT

A heat pump defrost system for efficiently defrosting an outdoor coil while simultaneously operating the heat pump in a normal heating manner. The heat pump defrost system generally includes a primary flow circuit including an indoor heat exchanger, an outdoor heat exchanger, a compressor connected thereto and a reverse valve for toggling a direction of refrigerant flow therethrough, and an auxiliary flow circuit for deicing the outdoor heat exchanger. The auxiliary flow circuit includes a valve for connecting the auxiliary flow circuit to the primary flow circuit, a heat sink in line with the auxiliary flow circuit, wherein the heat sink stores defrost fluid within the auxiliary flow circuit, at least one thermostat to read an outdoor ambient temperature and a control unit for operatively engaging the valve to direct the hot gas from the compressor of the primary circuit within the auxiliary flow circuit and the heat pump according to the outdoor ambient temperature for deicing the outdoor heat exchanger.

20 Claims, 5 Drawing Sheets

HEAT PUMP DEFROST SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to air source heat pumps and more specifically it relates to a heat pump defrost system for efficiently defrosting an outdoor coil while simultaneously operating the heat pump in a normal heating manner.

2. Description of the Related Art

Any discussion of the related art throughout the specification should in no way be considered as an admission that such related art is widely known or forms part of common general knowledge in the field.

Air source heat pumps are commonly utilized for heating and cooling interior spaces of homes because of their high efficiency that lead to cost savings over time. The heat pumps transfer energy in the form of heat from a cooler location to a warmer location. During cold temperature regions, in which the outdoor ambient air temperature is less than approximately 32 degrees Fahrenheit, it is common for the outdoor coils of the heat pump to accumulate frost and ice, thus blocking air flow and preventing the heat pump from operating effectively.

Present day air source heat pumps have a defrost cycle to clear frost from the outdoor coil when the temperature is below freezing. The defrost cycle takes heat from the indoor area to generate enough heat to defrost the outdoor coil. This usually happens at predetermined intervals and lasts for a predetermined amount of time. When the defrost starts the defrost control brings on the back-up heat source to heat the house, which may be comprised of an electric heat source or other.

The back-up heat source, however, is often times less efficient than the heat pump. Thus, the heat pump is operating at a high efficiency to defrost the outdoor coils and the primary area of interest, which is the interior space of the home, is being heated with a less efficient heat source, such as an electric heater. This can add to costs associated with heating a home, as well as an overall uncomfortable feeling of the house becoming slightly cooler while waiting for the electric heat source to take over and heat the house while the heat pump is in the defrosting cycle. Because of the inherent problems with the related art, there is a need for a new and improved heat pump defrost system for efficiently defrosting an outdoor coil while simultaneously operating the heat pump in a normal heating manner.

BRIEF SUMMARY OF THE INVENTION

The general purpose of the present invention is to provide a heat pump defrost system that has many of the advantages of the air source heat pumps mentioned heretofore. The invention generally relates to an air source heat pump which includes a primary flow circuit including an indoor heat exchanger, an outdoor heat exchanger, a compressor connected thereto and a reverse valve for toggling a direction of refrigerant flow therethrough, and an auxiliary flow circuit for deicing the outdoor heat exchanger. The auxiliary flow circuit includes a valve for connecting the auxiliary flow circuit to the primary flow circuit, a heat sink in line with the auxiliary flow circuit, wherein the heat sink stores defrost fluid within the auxiliary flow circuit, at least one thermostat to read an outdoor ambient temperature and a control unit for operatively engaging the valve to direct the hot gas from the compressor of the primary circuit within the auxiliary flow circuit and the heat pump according to the outdoor ambient temperature for deicing the outdoor heat exchanger.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a heat pump defrost system for efficiently defrosting an outdoor coil while simultaneously operating the heat pump in a normal heating manner.

Another object is to provide a heat pump defrost system that includes a heat sink connected to the outdoor coil to defrost the coil when needed.

An additional object is to provide a heat pump defrost system that may be installed with a new air source heat pump or retrofitted to a pre-existing system.

A further object is to provide a heat pump defrost system that only utilizes the connected heat sink during specific temperature ranges.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
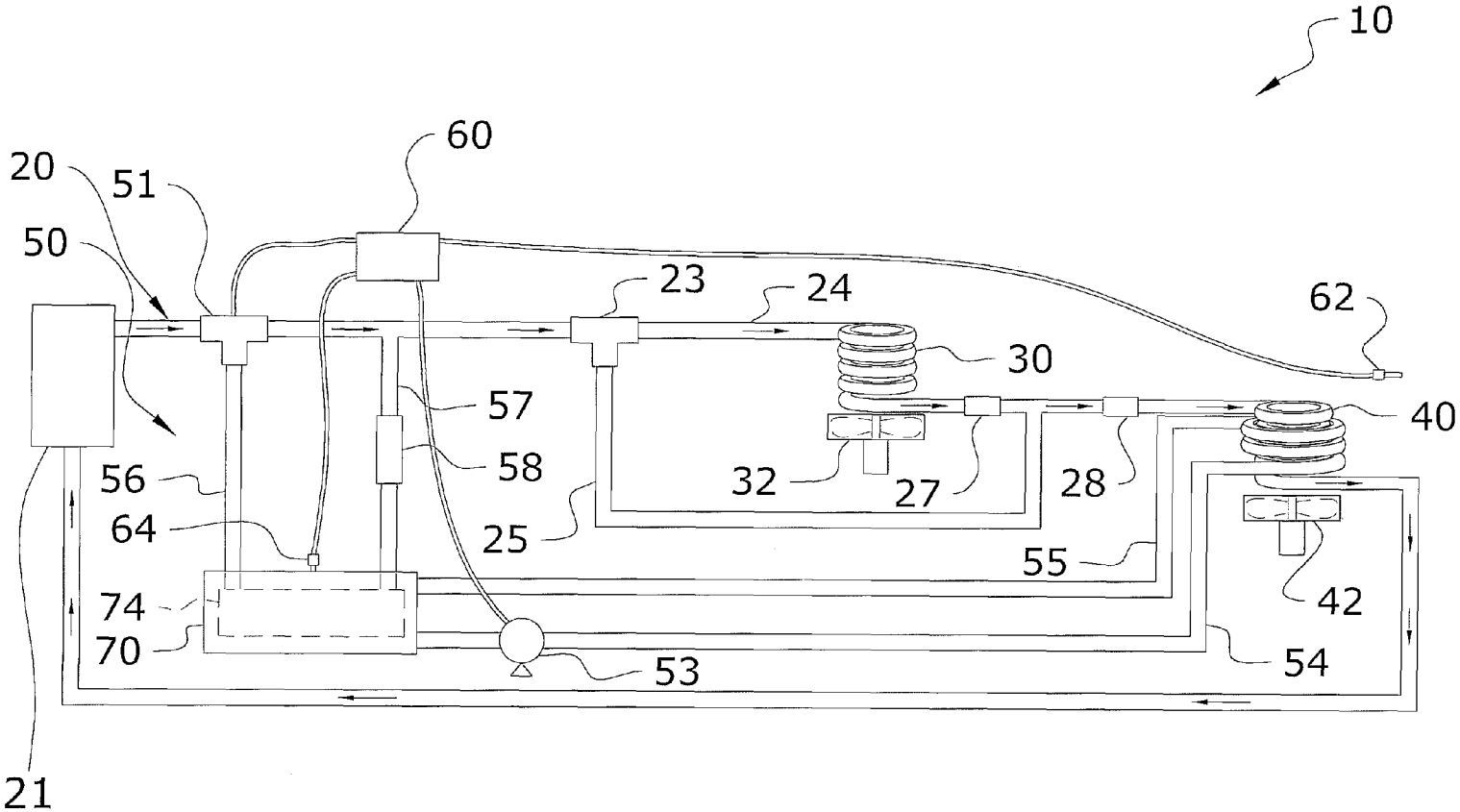
FIG. 1 is a schematic of the present invention operating in a heating mode with the primary flow circuit.
Figure 2:
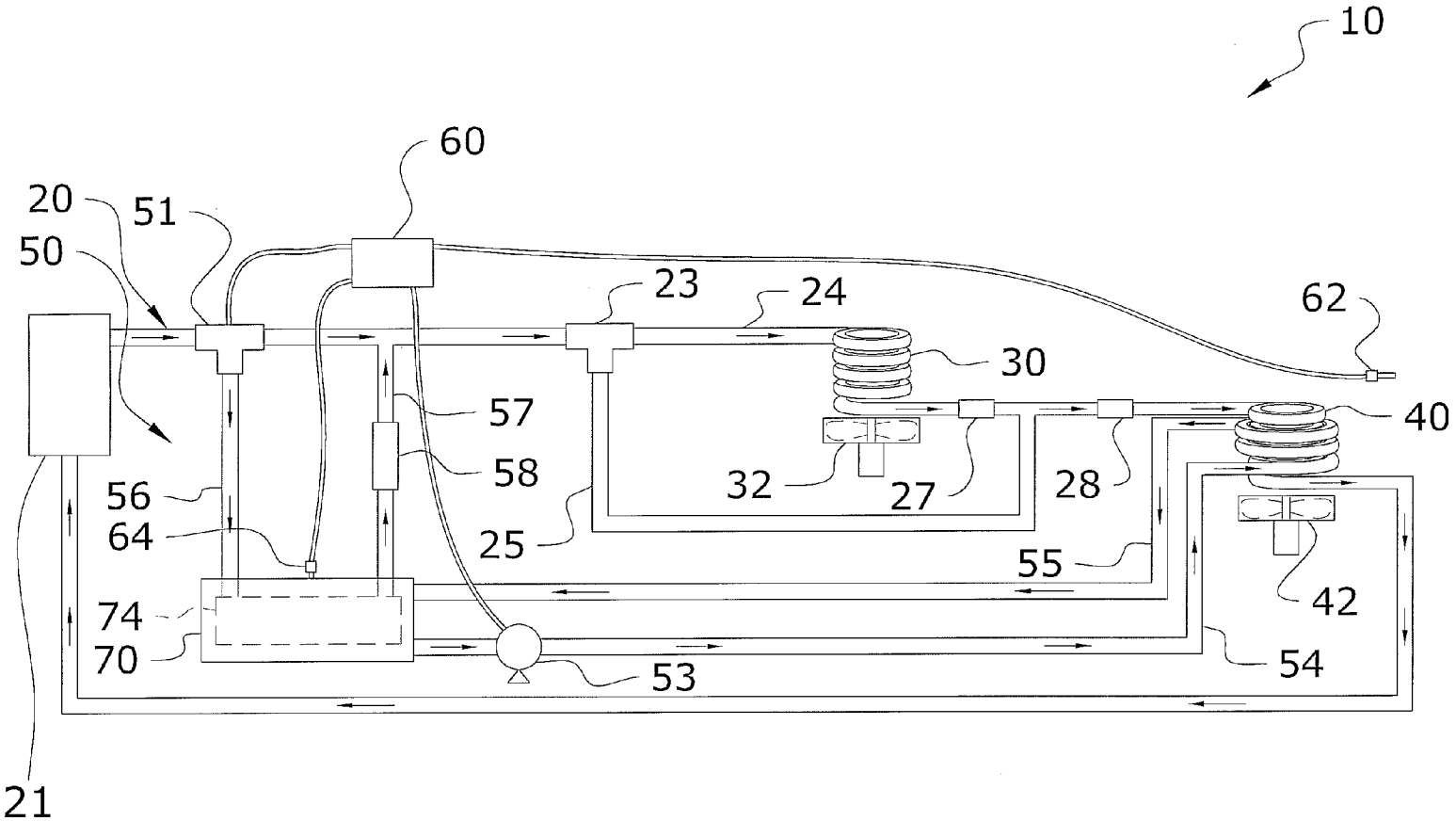
FIG. 2 is a schematic of the present invention operating in a heating mode with the primary flow circuit and simultaneously defrosting the outdoor heat exchanger with the auxiliary flow circuit.
Figure 3:
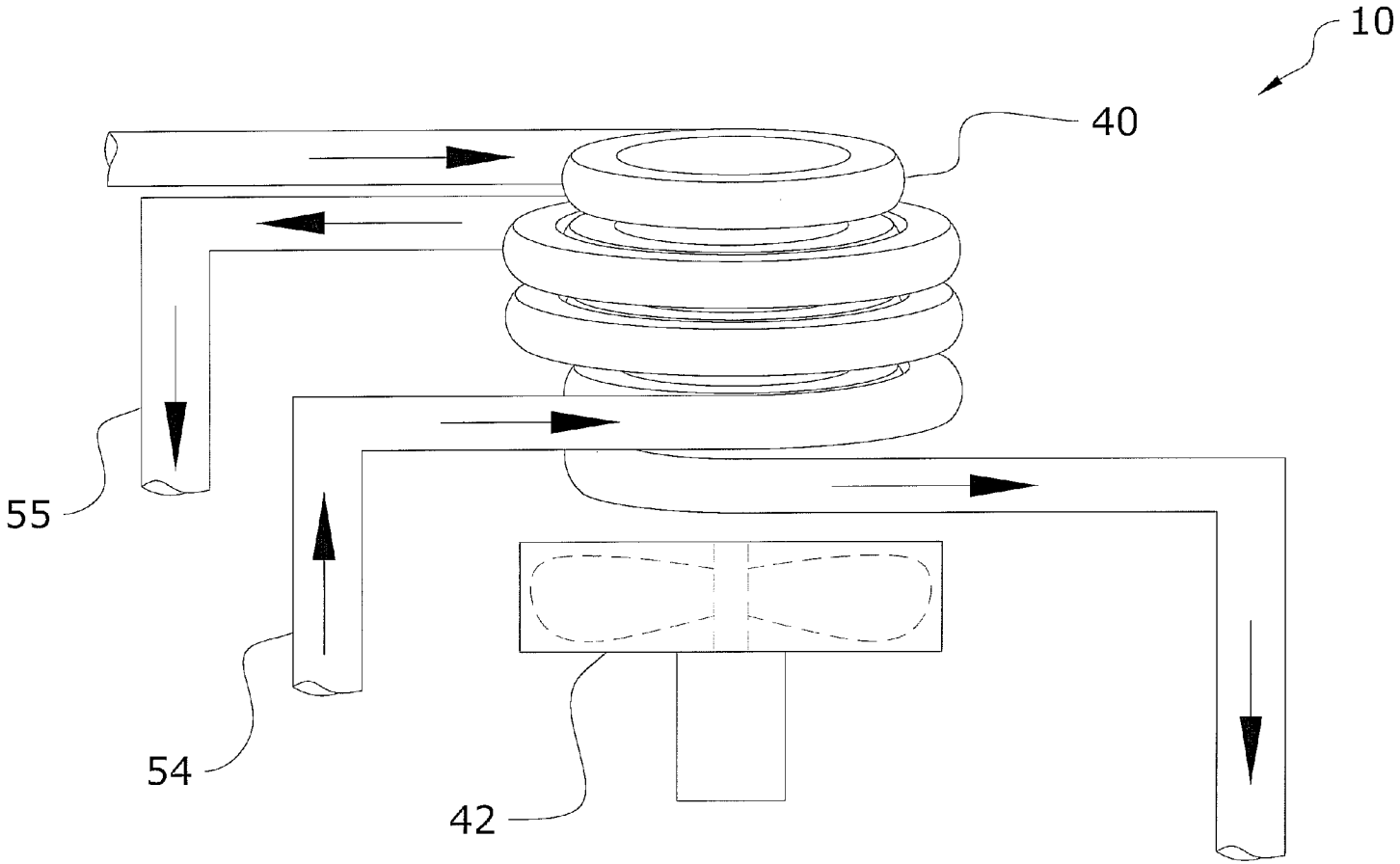
FIG. 3 is a magnified schematic view of the outdoor heat exchanger and the coil of the first portion of the auxiliary flow circuit.
Figure 4:
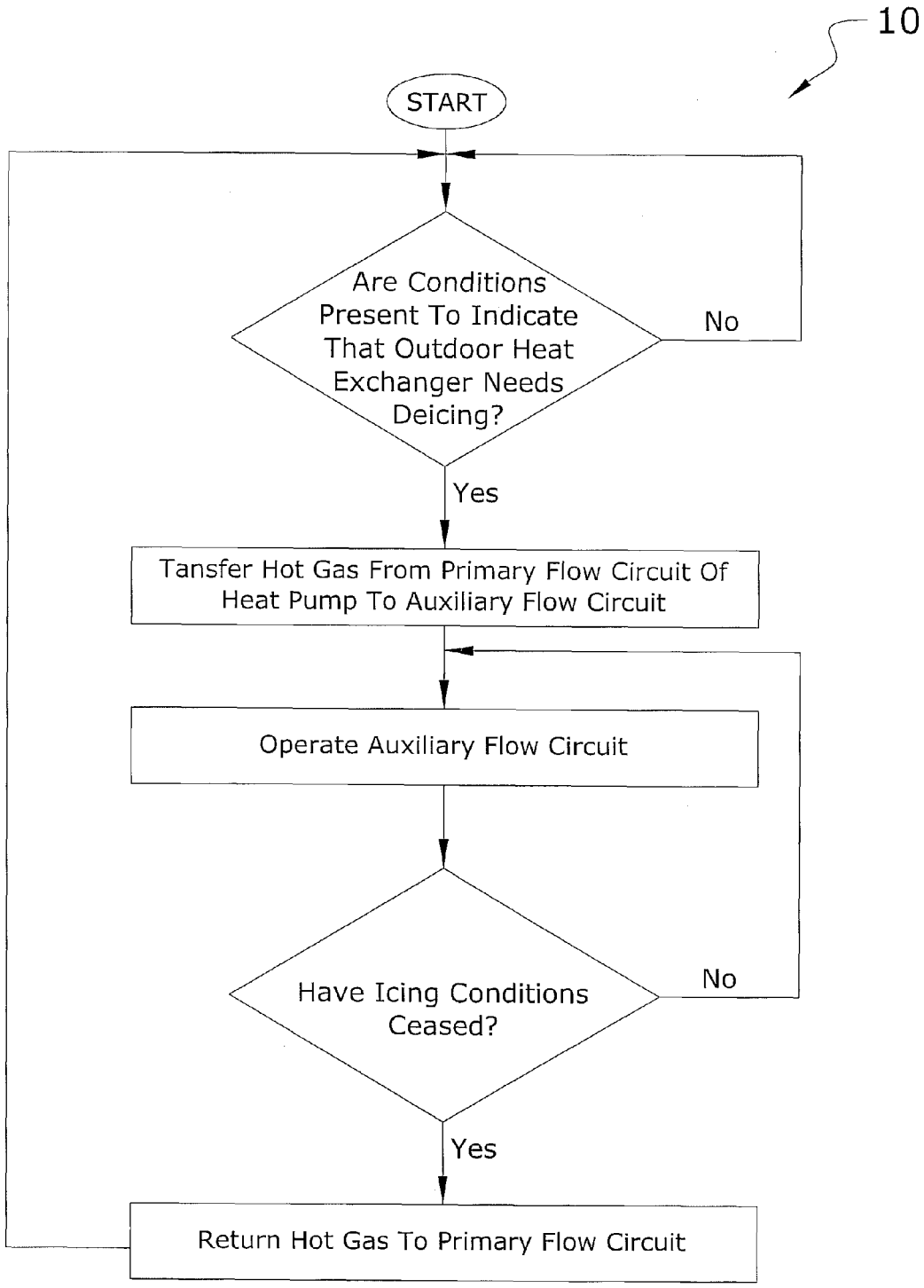
FIG. 4 is a first flowchart of the operation of the present invention.
Figure 5:
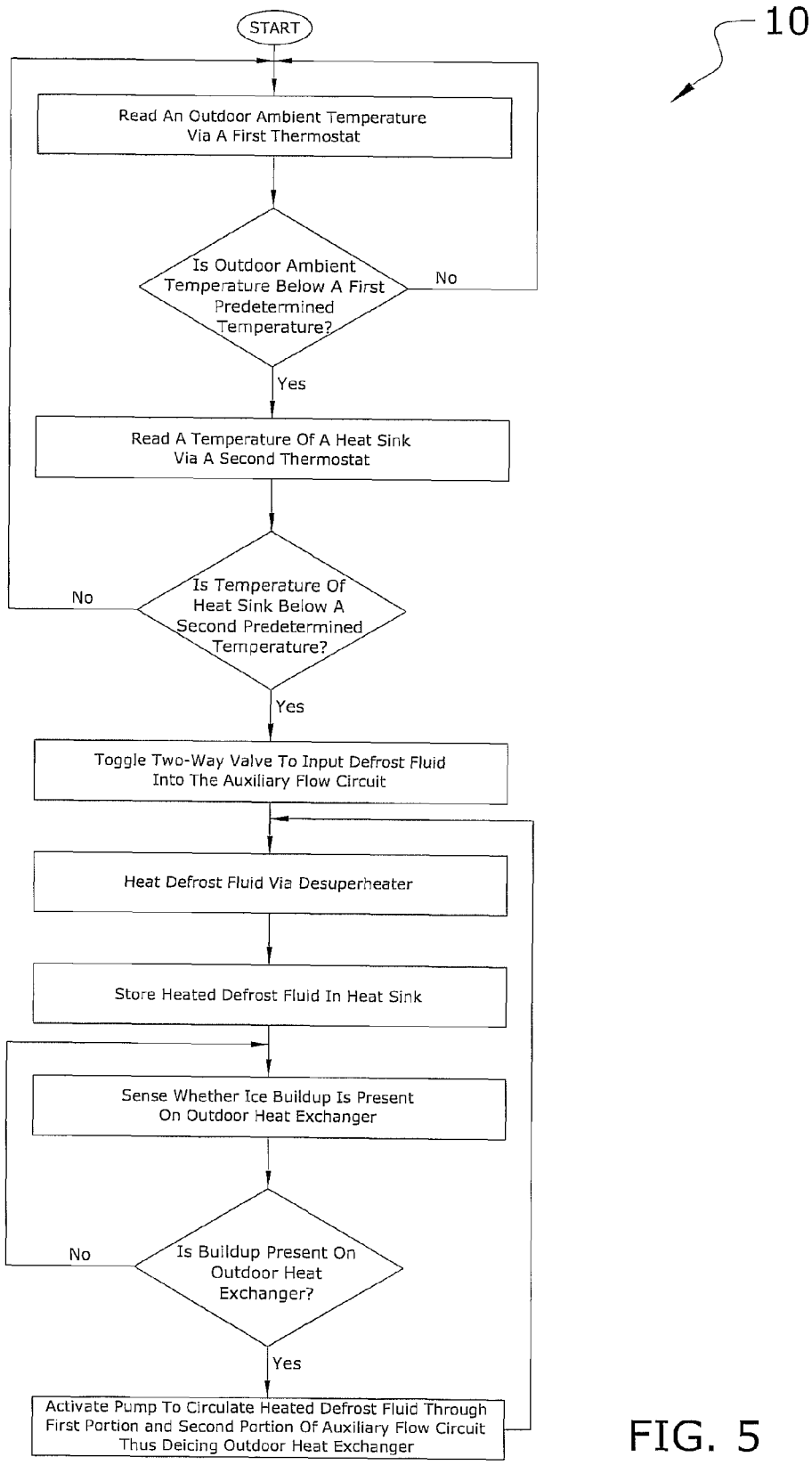
FIG. 5 is a second detailed flowchart of the operation of the present invention.

Turning now descriptively to the drawings, in which similar reference characters denote similar elements throughout the several views, FIGS. 1 through 5 illustrate a heat pump defrost system 10, which comprises a primary flow circuit 20 including an indoor heat exchanger 30, an outdoor heat exchanger 40, a compressor 21 connected thereto and a reverse valve 23 for toggling a direction of refrigerant flow therethrough, and an auxiliary flow circuit 50 for deicing the outdoor heat exchanger 40. The auxiliary flow circuit 50 includes a valve 51 for connecting the auxiliary flow circuit 50 to the primary flow circuit 20, a heat sink 70 in line with the auxiliary flow circuit 50, wherein the heat sink 70 stores defrost fluid within the auxiliary flow circuit 50, at least one thermostat 62 to read an outdoor ambient temperature and a control unit 60 for operatively engaging the valve 51 to direct hot gas within the auxiliary flow circuit 50 and the heat pump 10 according to the outdoor ambient temperature for deicing the outdoor heat exchanger 40. It is appreciated that the defrost fluid may also be substituted with ethylene glycol.

B. Primary Flow Circuit (Heating and Cooling)

The present invention includes a primary flow circuit 20 to primarily provide for the heating and cooling of the interior space in which the flow circuit 20 is directed to. The primary flow circuit 20 generally is connected by components to function as an air source heat pump 10. The heat pump 10 further includes a refrigerant compressor 21, an indoor heat exchanger 30, expansion valves 27, 28, and an outdoor heat exchanger 40 all connected by the primary flow circuit 20. The indoor heat exchanger 30 and the outdoor heat exchanger 40 are primarily comprised of coils or other configurations that are common to air source heat pumps 10 to efficiently gather and distribute cool and warm air.

The primary flow circuit 20 is configured to provide for both cooling and heating functions from both heat exchangers, wherein the indoor heat exchanger 30 outputs cool air during warm periods and hot air during cold periods from the oppositely performing outdoor heat exchanger 40. The indoor heat exchanger 30 includes an air handler means 32, such as a blower, fan, or other mechanism. The air handler means 32 may further include ductwork or other channeling devices to transport the warm or cool air from the indoor heat exchanger 30 throughout the interior space in which the warm or cool air is to be directed. The outdoor heat exchanger 40 likewise includes an air handler means 42, such as a blower, fan, or other mechanism for directing airflow along the outdoor heat exchanger 40 to assist in the heating and cooling process.

The primary flow circuit 20 includes a reverse valve 23 to direct the primary flow circuit 20 toward a heating flow or cooling flow is adjusted according to if the indoor heat exchanger 30 is currently desired to be used for heating or cooling. The reverse valve 23 is positioned upstream of the indoor heat exchanger 30 to direct either the heating flow 24 towards the indoor heat exchanger 30 or the cooling flow 25 around the indoor heat exchanger 30 thus bypassing the indoor heat exchanger 30 towards the outdoor heat exchanger 40. The reverse valve 23 controls the direction of the refrigerant fluid or gas through the primary flow circuit 20. The reverse valve 23 may be controlled or switched via various controls operative via the user of the heat pump 10 or automatically operated according to an outdoor or indoor ambient temperature.

The primary flow circuit 20 includes expansion valves 27, 28 known in the art of air source heat pumps 10 to lower the pressure of the condensed refrigerant. The expansion valves 27, 28 may include or be substituted for various other similar performing devices, such as capillary tubes or other work-extracting devices. The primary flow circuit 20 generally includes a first expansion valve 27 positioned downstream of the indoor heat exchanger 30 for use when the heat pump 10 is a heating mode through the heating portion 24 and the heated refrigerant is directed through the indoor heat exchanger 30. A second expansion valve 28 may alternatively or additionally be used during a cooling mode via the cooling portion 25 and is positioned downstream of the cooling flow portion 25 from the reverse valve 23 and upstream of the outdoor heat exchanger 40. It is appreciated that during heating mode the refrigerant may be channeled through both expansion valves 27, 28, however during cooling mode the first expansion valve 27 will be bypassed and only the second expansion valve 28 utilized.

The outdoor heat exchanger 40 is connected to the compressor 21 opposite the indoor heat exchanger 30 to complete the primary flow circuit 20. The primary flow circuit 20 is able to continually operate during cool and warm periods to output cool and warm air into the desired interior space via the interior heat exchanger 30.

C. Auxiliary Flow Circuit (Defrost)

The present invention includes an auxiliary flow circuit 50 to assist in heating the outdoor heat exchanger 40 during times of need. It is appreciated that during cold periods (i.e. below freezing temperatures), frost or ice may accumulate upon the outdoor heat exchanger 40, thus decreasing the efficiency of the heat pump 10 or all together blocking an air flow across the outdoor heat exchanger 40. A two-way valve 51 positioned downstream of the compressor 21 to receive the hot refrigerant gas from the compressor 21 connects the primary flow circuit 20 to an auxiliary flow circuit 50. The auxiliary flow circuit 50 operates substantially in parallel to the primary flow circuit 20, wherein both flow circuits may operate continuously and simultaneously. The auxiliary flow circuit 50 is utilized defrost or deice the outdoor heat exchanger 40 so that the heat pump 10 may continue to operate at optimal efficiency.

The two-way valve 51 connects the primary flow circuit 20 to the first connecting portion 56 of the auxiliary flow circuit 50, which leads to the desuperheater 74 and heat sink 70. The heat sink 70 stores defrost fluid for use in the auxiliary flow circuit 50. It is appreciated that the defrost fluid is only used in the auxiliary flow circuit 50 and not transferred over to the primary flow circuit 20.

The two-way valve 51 may be controlled manually in various embodiments of the present invention. However, it is preferred that a control unit 60 be used to automatically toggle the two-way valve 51 when the auxiliary flow circuit 50 needs to be utilized. The control unit 60 is connected to a plurality of thermostats 62, 64. The thermostats read the outdoor ambient air temperature and the temperature of a heat sink 70 of the auxiliary flow circuit 50.

The first thermostat 62 measures the outdoor air ambient temperature that is communicated to the control unit 60, wherein the control unit 60 toggles the two-way valve 51 when the first thermostat reads an outdoor ambient temperature of below 35 degrees Fahrenheit (F). If the outdoor temperature is above this, the outdoor heat exchanger 40 is not in danger of becoming frosted or iced and thus the auxiliary flow circuit 50 is not needed.

The second thermostat 64 measures the temperature of the heat sink 70 connected to the auxiliary flow circuit 50. The second temperature is also communicated to the control unit 60, wherein the control unit 60 toggles the two-way valve 51 if the heat sink 70 temperature is below 180 degrees F. If the heat sink 70 temperature is above this, the heat sink 70 is appropriately heated and does not need further heating to defrost the outdoor heat exchanger 40. It is appreciated that the various other temperatures may be set as predetermined temperatures rather than those used in the preferred embodiment. The sensor or air pressure switch is positioned proximate the outdoor heat exchanger 40 to detect when ice buildup occurs on the outdoor heat exchanger 40. Defrost fluid is thus fed to the first portion 54 and towards the outdoor heat exchanger 40 when the air pressure switch detects ice buildup.

The auxiliary flow circuit 50 includes the heat sink 70 positioned downstream of the two-way valve 51. The heat sink 70 includes a desuperheater 74 to heat the defrost fluid when reaching the outdoor heat exchanger 40. A first portion 54 of the auxiliary flow circuit 50 connects the heat sink 70 to the outdoor heat exchanger 40 to allow the heated defrost fluid to travel along the outdoor heat exchanger 40 to defrost or deice the outdoor heat exchanger 40 through the heat of the first portion 54. A pump 53 is connected along the first portion 54 to transfer the fluid. It is appreciated that the first portion 54 is not fluidly connected to the heat exchanger and preferably travels side-by-side and adjacent to the outdoor heat exchanger 40, wherein the first portion 54 may be coiled similarly to the outdoor heat exchanger 40.

A second portion 55, integral and fluidly connected to the first portion 54, of the auxiliary flow circuit 50 returns the defrost fluid to the heat sink 70 where it is reheated by the desuperheater 74 for later defrosting or deicing of the outdoor heat exchanger 40. It is appreciated that the returned hot gas from the defrost fluid may also be fed back into the primary flow circuit 20 via a second connecting portion 57 of the auxiliary flow circuit 50. A check valve 58 is interconnected along the connecting portion 57 to ensure that the refrigerant does not flow from the primary flow circuit 20 to the auxiliary flow circuit 50 and only the hot gas from the auxiliary flow circuit 50 to the primary flow circuit 20.

D. Operation of Preferred Embodiment

In use, the heat pump 10 functions in a standard heating and cooling manner using the primary flow circuit 20 to circulate refrigerant through the indoor heat exchanger 30 and outdoor heat exchanger 40. When the outdoor ambient temperature is below 35 degrees F., the control unit 60 senses that the outdoor heat exchanger 40 is in danger of accumulating frost or ice thereon. The control unit 60 checks to see if the heat sink 70 is also below a temperature of 180 F, wherein if the heat sink 70 is above the predetermined temperature the auxiliary flow circuit 50 has already been in operation to heat the outdoor heat exchanger 40 so as to remove the ice or frost.

If both temperature conditions are met, the control unit 60 toggles the two-way valve 51 to allow a small amount of heated gas from the compressor 21 and primary flow circuit 20 to enter into the auxiliary flow circuit 50. The desuperheater 74 within the auxiliary flow circuit 50 uses the hot gas to heat the stored defrost fluid in the heat sink 70 and transfers the heated defrost fluid in predetermined intervals or continuously to the first portion 54 of the auxiliary flow circuit 50 to heat the outdoor heat exchanger 40.

In the preferred embodiment, the heated defrost fluid is transferred to heat the outdoor heat exchanger 40 when the air pressure switch along the outdoor heat exchanger 40 detects ice buildup upon the outdoor heat exchanger 40. Likewise, when the buildup ceases to exist upon the outdoor heat exchanger 40, the pump 53 along the first portion 54 stops and thus the flow of the defrost fluid through the first portion 54 stops.

The defrost fluid flows to the second portion 55 of the auxiliary flow circuit 50 where it is returned to the heat sink 70 to be reheated by the desuperheater 74 or stored for future use. Liquid from the defrost fluid may be returned to the primary flow circuit 20. It is appreciated that during the defrosting cycle of the auxiliary flow circuit 50, the primary flow circuit 20 continues to operate to warm the interior space of the house. Thus, any back-up heat source, such as an electric heater, is not needed while defrosting the outdoor heat exchanger 40.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An air source heat pump for heating and cooling an indoor space comprising a primary flow circuit including an indoor heat exchanger, an outdoor heat exchanger, a compressor connected thereto and a reverse valve for toggling a direction of refrigerant flow therethrough, and an auxiliary flow circuit using a defrost fluid for deicing said outdoor heat exchanger, comprising:

a valve for connecting said auxiliary flow circuit to said primary flow circuit;

a heat sink in line with said auxiliary flow circuit, wherein said heat sink stores at least a portion of said defrost fluid within said auxiliary flow circuit;

at least one thermostat to read an outdoor ambient temperature; and a control unit for operatively engaging said valve to direct hot gas from said compressor within said auxiliary flow circuit to heat said defrost fluid according to said outdoor ambient temperature;

wherein said heated defrost fluid is channeled through said auxiliary flow circuit for deicing said outdoor heat exchanger.

2. The heat pump of claim 1, wherein said auxiliary flow circuit operates substantially independently of said primary flow circuit.

3. The heat pump of claim 1, wherein said auxiliary flow circuit operates simultaneously with said primary flow circuit.

4. The heat pump of claim 1, wherein said at least one thermostat includes a second thermostat for reading a temperature of said heat sink.

5. The heat pump of claim 4, wherein said control unit toggles said valve according to said temperature of said heat sink.

6. The heat pump of claim 1, including a sensor positioned proximate said outdoor heat exchanger for detecting ice buildup upon said outdoor heat exchanger.

7. The heat pump of claim 6, wherein said sensor is comprised of an air pressure switch.

8. The heat pump of claim 6, including a pump in line with said auxiliary flow circuit to direct defrost fluid from said heat sink towards said outdoor heat exchanger according to said ice buildup reading of said sensor.

9. The heat pump of claim 8, wherein said control unit activates said pump.

10. The heat pump of claim 1, including a desuperheater inline with said auxiliary flow circuit for heating a defrost fluid.

11. The heat pump of claim 10, wherein said desuperheater is positioned within said heat sink.

12. The heat pump of claim 1, wherein said auxiliary flow circuit includes a first portion intertwined with said outdoor heat exchanger.

13. The heat pump of claim 12, wherein said auxiliary flow circuit includes a second portion to return reconnect said first portion with said heat sink to form a circulating loop for defrost fluid within said auxiliary flow circuit.

14. A method of deicing an outdoor heat exchanger of an air source heat pump, comprising:

reading an outdoor ambient temperature;

determining if said outdoor ambient temperature is below a first predetermined temperature;

providing a heat sink to store defrost fluid prior to deicing;

toggling a valve to input hot gas into said heat sink if said outdoor ambient temperature is below said first predetermined temperature;

heating said defrost fluid with said hot gas;

sensing a condition indicative of ice buildup upon said outdoor heat exchanger;

activating a pump fluidly connected to said heat sink;

circulating said defrost fluid through an auxiliary flow circuit; and heating said outdoor heat exchanger to remove said sensed ice buildup upon said outdoor heat exchanger.

15. The method of claim 14, including the steps of:

reading a temperature of a heat sink;

determining if said temperature of said heat sink is below a second predetermined temperature;

toggling said valve to input said hot gas into said heat sink if said outdoor ambient temperature is below said first predetermined temperature and said temperature of said heat sink is below said second predetermined temperature.

16. The method of claim 14, including a desuperheater to heat said defrost fluid stored in said heat sink.

17. The method of claim 14, wherein said first predetermined temperature is slightly above a water freezing temperature.

18. An air source heat pump for heating and cooling an indoor space comprising a primary flow circuit including an indoor heat exchanger, an outdoor heat exchanger, a compressor connected thereto, a pair of air handling means for directing hot or cold air from said indoor heat exchanger and said outdoor heat exchanger and a reverse valve for toggling a direction of refrigerant flow therethrough, and an auxiliary flow circuit for deicing said outdoor heat exchanger, comprising:

a valve for connecting said auxiliary flow circuit to said primary flow circuit;

a heat sink in line with said auxiliary flow circuit, wherein said heat sink stores at least a portion of defrost fluid within said auxiliary flow circuit;

a first thermostat to read an outdoor ambient temperature;

a control unit for operatively engaging said valve to direct hot gas from said compressor within said auxiliary flow circuit according to said outdoor ambient temperature for deicing said outdoor heat exchanger;

wherein said auxiliary flow circuit includes a first portion intertwined with said outdoor heat exchanger;

wherein said auxiliary flow circuit includes a second portion to return reconnect said first portion with said heat sink to form a circulating loop for said defrost fluid within said auxiliary flow circuit;

wherein said auxiliary flow circuit operates simultaneously with said primary flow circuit;

a sensor positioned proximate said outdoor heat exchanger for detecting ice buildup upon said outdoor heat exchanger;

wherein said sensor is comprised of an air pressure switch;

a pump in line with said auxiliary flow circuit to direct said defrost fluid from said heat sink towards said outdoor heat exchanger according to said ice buildup reading of said sensor;

wherein said control unit activates said pump; and a desuperheater inline with said auxiliary flow circuit for heating said defrost fluid.

19. The heat pump of claim 18, including a second thermostat for reading a temperature of said heat sink.

20. The heat pump of claim 19, wherein said control unit toggles said valve according to said temperature of said heat sink.

* * * * *